US006915598B2

(12) United States Patent
Grisoni et al.

(10) Patent No.: US 6,915,598 B2
(45) Date of Patent: Jul. 12, 2005

(54) INSOLE WITH ARCH SPRING

(75) Inventors: Bernard F. Grisoni, Cordova, TN (US); Philip Yang, Memphis, TN (US); Harold A. Howlett, Nesbit, MS (US); Laura J. Crane, Williston, TN (US)

(73) Assignee: Schering-Plough Healthcare Products Inc., Memphis, TN (US)

( * ) Notice: Subject to any disclaimer, the term of this patent is extended or adjusted under 35 U.S.C. 154(b) by 82 days.

(21) Appl. No.: 10/212,913

(22) Filed: Aug. 6, 2002

(65) Prior Publication Data

US 2004/0025376 A1 Feb. 12, 2004

(51) Int. Cl.[7] ..... A61F 5/14; A43B 7/14

(52) U.S. Cl. ..... 36/151; 36/168; 36/179; 36/149

(58) Field of Search ..... 36/151, 168, 179, 36/107, 108, 27, 28, 44, 76 C, 148, 149

(56) References Cited

U.S. PATENT DOCUMENTS

| | | | | | |
|---|---|---|---|---|---|
| 3,601,908 | A | * | 8/1971 | Gilkerson | 36/44 |
| 4,176,476 | A | * | 12/1979 | Hassell | 36/44 |
| 4,231,169 | A | * | 11/1980 | Toyama et al. | 36/44 |
| 4,597,196 | A | * | 7/1986 | Brown | 36/44 |
| 4,800,657 | A | * | 1/1989 | Brown | 36/44 |
| 4,879,821 | A | * | 11/1989 | Graham et al. | 36/44 |
| 5,390,430 | A | * | 2/1995 | Fitchmun et al. | 36/30 R |
| 5,722,186 | A | * | 3/1998 | Brown | 36/43 |
| 6,120,880 | A | * | 9/2000 | Crow | 36/4 |

FOREIGN PATENT DOCUMENTS

| | | | | |
|---|---|---|---|---|
| DE | 28 08 127 | A1 | 8/1979 | |
| DE | G 92 01 704.5 | U1 | 7/1992 | |
| EP | 1 090 563 | A2 | 4/2001 | |
| EP | 1 116 449 | A2 | 7/2001 | |
| GB | 2230935 | * | 11/1990 | A43B/13/41 |
| WO | 99/33417 | A1 | 7/1999 | |
| WO | 02/00052 | A1 | 1/2002 | |

* cited by examiner

*Primary Examiner*—Anthony Stashick
(74) *Attorney, Agent, or Firm*—Richard M. Goldberg; James M. Gould; Robert J. Lipka

(57) ABSTRACT

An insole for use with footwear includes a first layer including a heel portion of a first thickness, a mid portion connected to a front section of the heel portion and having a substantially constant thickness which is much less than the first thickness, and having an upward curvature, an upper surface extending along the mid and heel portions and on which a person stands, and a lower surface extending along the mid and heel portions, the lower surface including a shallow recess in the mid portion, the first layer being made of a material of a first hardness; and a flexible and resilient, thin arch spring insert of a substantially constant thickness secured in the recess and following the curvature of the mid portion, the arch spring insert being made of a material of a second hardness which is greater than the first hardness.

18 Claims, 9 Drawing Sheets

INSOLE WITH ARCH SPRING

INTRODUCTION TO THE INVENTION

The present invention relates generally to insoles for footwear and, more particularly, to improved insoles having an arch spring.

Conventionally, contoured insoles have arch portions that are made primarily of thick, bulky insole material, such as a foam material. However, this can be disadvantageous, for example, when used with shoes having a built-in arch portion, since the thick, bulky arch portion introduces excessive bulk under the foot that can cause foot discomfort. Further, such an insole might not be capable of use in a shoe already having a built-in arch support, since the combination may be too bulky for comfort.

In addition, with such conventional bulky arch portions, in order to change the stiffness of the arch portion, it is necessary to change the foam material and thickness thereof, which becomes difficult to engineer in practice.

Also, with a bulky foam arch portion, the more that a person steps on the arch portion, thereby compressing the foam material, the stiffer the foam material becomes. Accordingly, the resistance of the foam material varies during the step. Thus, the use of a bulky foam material for the arch portion of an insole makes it more difficult to define, set or determine the stiffness of the arch, since it will vary for different body structures and different gaits.

SUMMARY OF THE INVENTION

Accordingly, it is a feature of the present invention to provide an insole that overcomes the problems with the aforementioned conventional insoles.

It is another feature of the present invention to provide an insole that replaces the bulky foam material in the arch portion with a relatively strong, thin resilient and flexible material that functions as a spring.

It is still another feature of the present invention to provide an insole which comfortably supports the arch area of the user's foot.

It is yet another feature of the present invention to provide an insole that flexes continually with the arch of the foot as it flattens during a stride.

It is a further feature of the present invention to provide an insole having an arch portion that adapts to the requirements of each person's foot.

It is a still further feature of the present invention to provide an insole in which the flexion of the arch portion changes throughout the step, providing a more controlled and constant resistance.

It is a yet further feature of the present invention to provide an insole having an arch portion which is suitable for different body types.

It is another feature of the present invention to provide an insole in which the arch portion elongates during a step to simulate natural body movements.

In accordance with an aspect of the present invention, an insole for use with footwear includes a first layer including a heel portion of a first thickness, a forefoot portion, a mid portion connecting together the forefoot portion and the heel portion, the mid portion having a substantially constant second thickness which is much less than the first thickness of the heel portion and having an upward curvature, an upper surface extending along the forefoot portion, mid portion and heel portion and on which a person stands, and a lower surface extending along the forefoot portion, mid portion and heel portion, the lower surface including a shallow recess in the mid portion, the first layer being made of a material of a first hardness; and a flexible and resilient, thin arch spring insert of a substantially constant thickness secured in the recess and following the curvature of the mid portion, the arch spring insert being made of a material of a second hardness which is greater than the first hardness.

The arch spring insert and the recess preferably have substantially the same shape and dimensions. Further, the arch spring insert optionally includes corner wing sections at a rear section thereof which extend slightly into the heel portion. The arch spring insert also optionally can taper in width toward a central section thereof. Preferably, the arch spring insert has a stiffness in the range between 5 and 60 pounds/inch (0.89 to 10.7 Kg/cm), more preferably in the range between 5 and 20 pounds/inch (0.89 to 3.57 Kg/cm).

The heel portion is cupped to maintain a heel of a person in the heel portion. The forefoot portion has a length such that, when in use, the forefoot portion ends immediately distally of the user's metatarsals.

The first layer is made of a soft, resilient foam material preferably having a Shore Type OO Durometer hardness in the range of 40 to 70, while the material of the arch spring insert generally has a flexural modulus in the range of 100,000 to 500,000 p.s.i. ($6.89 \cdot 10^8$ to $3.45 \cdot 10^9$ Newton/meter$^2$), preferably in the range of 150,000 to 400,000 p.s.i. ($1.03 \cdot 10^9$ to $2.76 \cdot 10^9$ N/m$^2$) and more preferably in the range of 180,000 to 230,000 p.s.i. ($1.24 \cdot 10^9$ to $1.59 \cdot 10^9$ N/m$^2$).

The above and other features of the invention will become readily apparent from the following detailed description thereof which is to be read in connection with the accompanying drawings.

DETAILED DESCRIPTION

Figure 1:
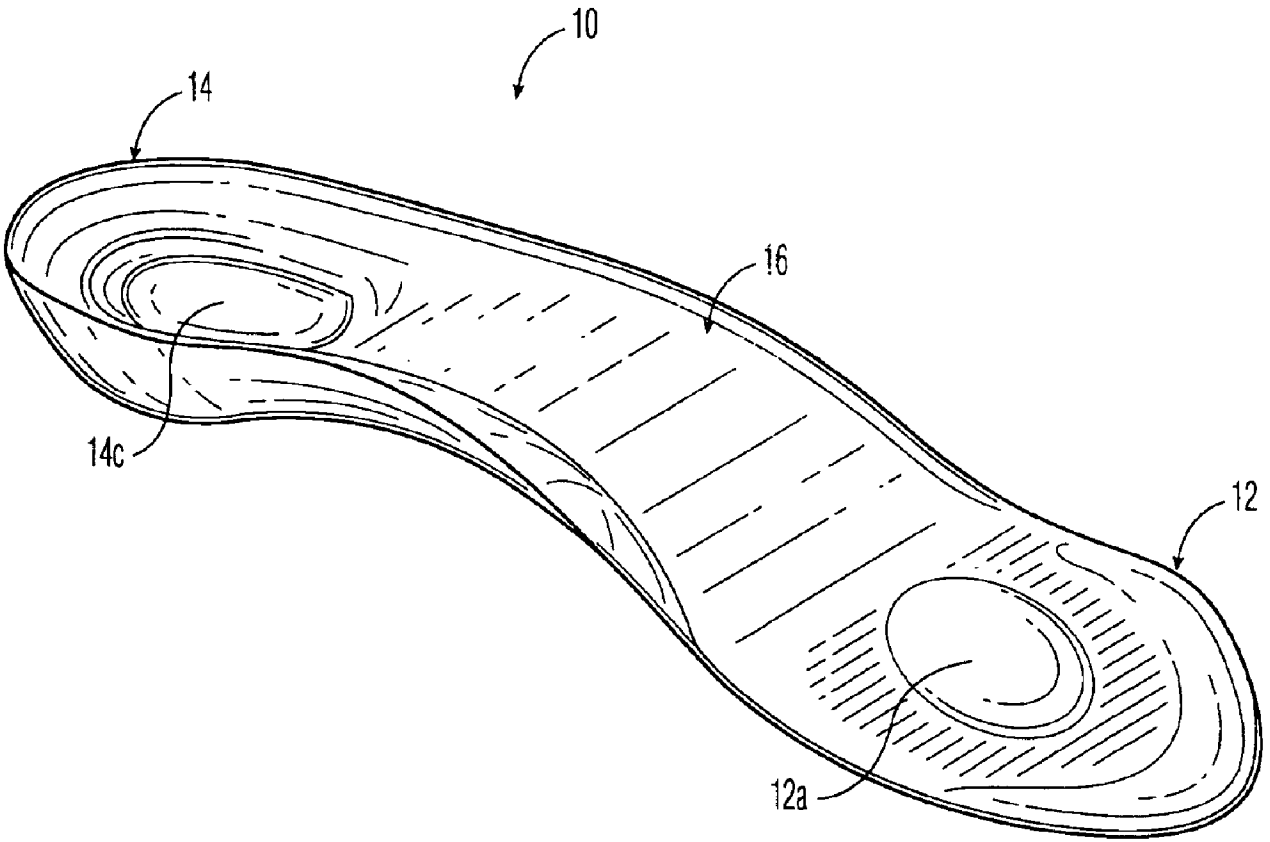
FIG. 1 is a top perspective view of a left insole according to the present invention.
Figure 2:
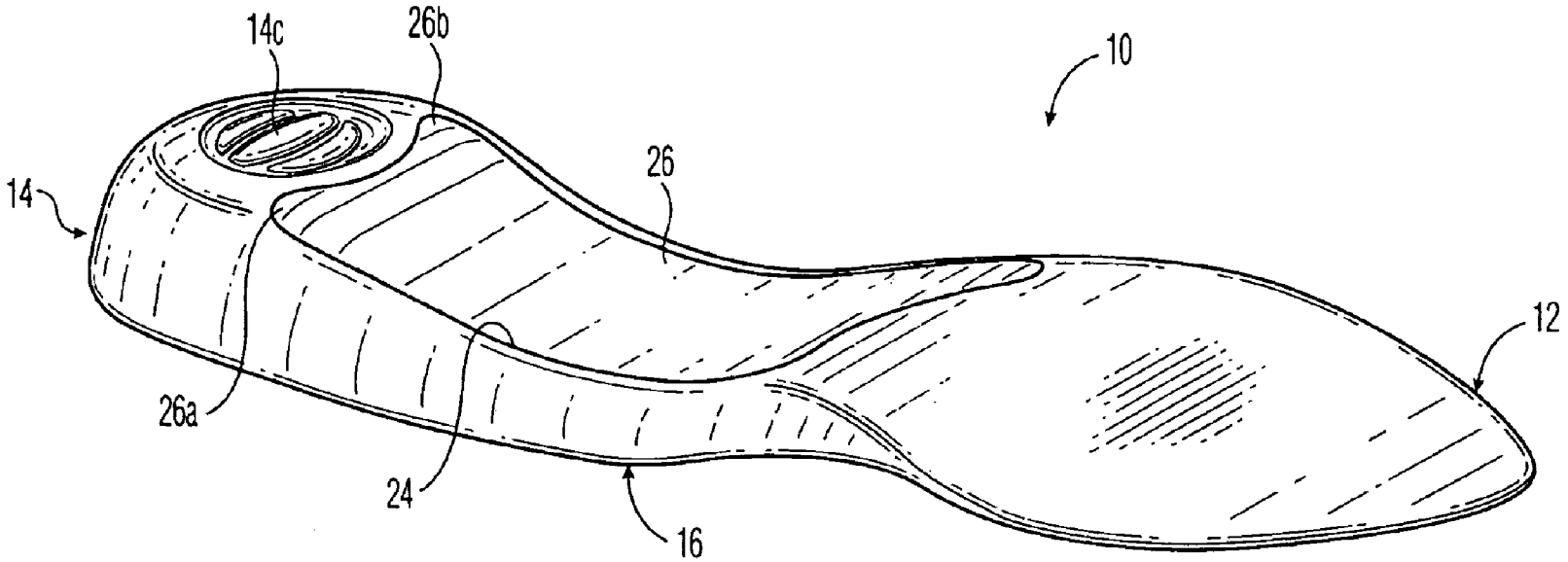
FIG. 2 is a bottom perspective view of the insole.
Figure 3:
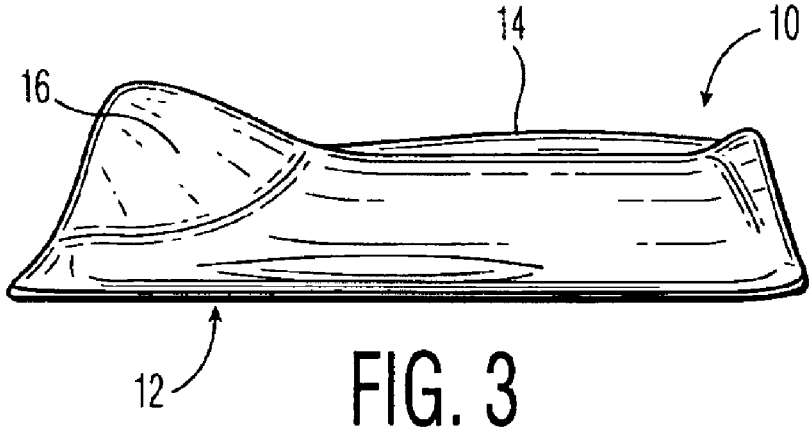
FIG. 3 is a front elevational view of the insole.
Figure 4:
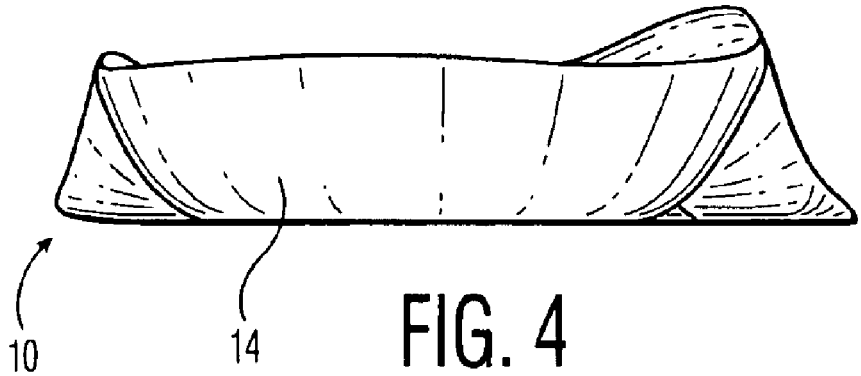
FIG. 4 is a rear elevational view of the insole.
Figure 5:
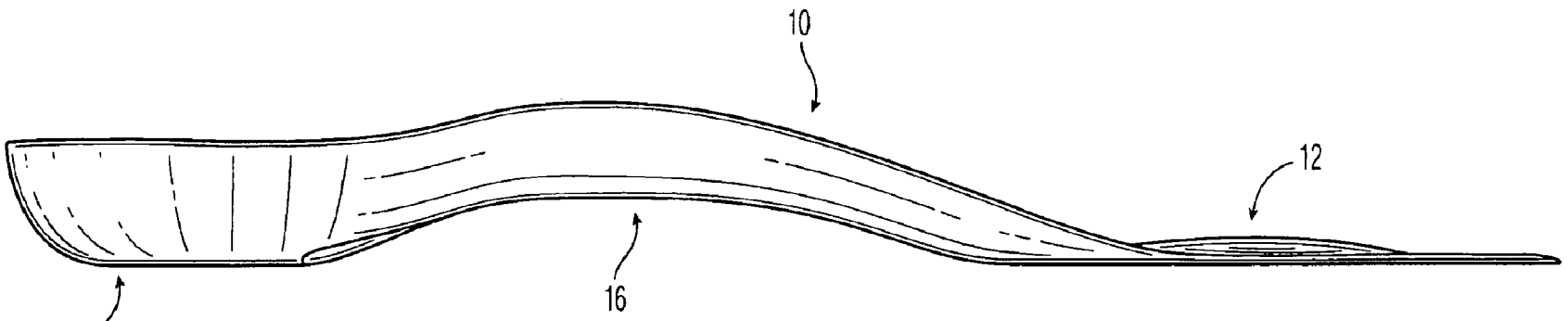
FIG. 5 is a right side elevational view of the insole.
Figure 6:
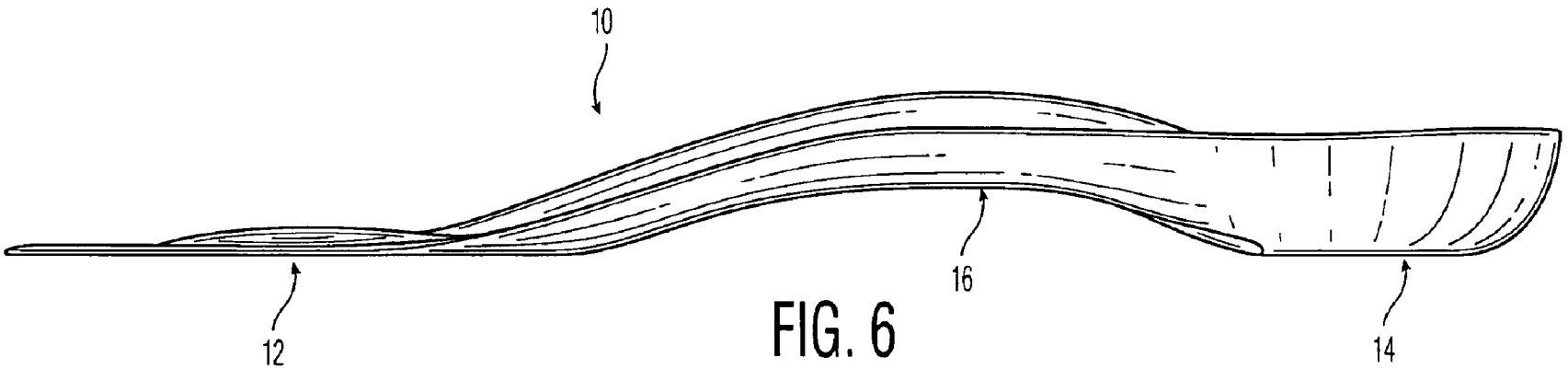
FIG. 6 is a left side elevational view of the insole.
Figure 7:
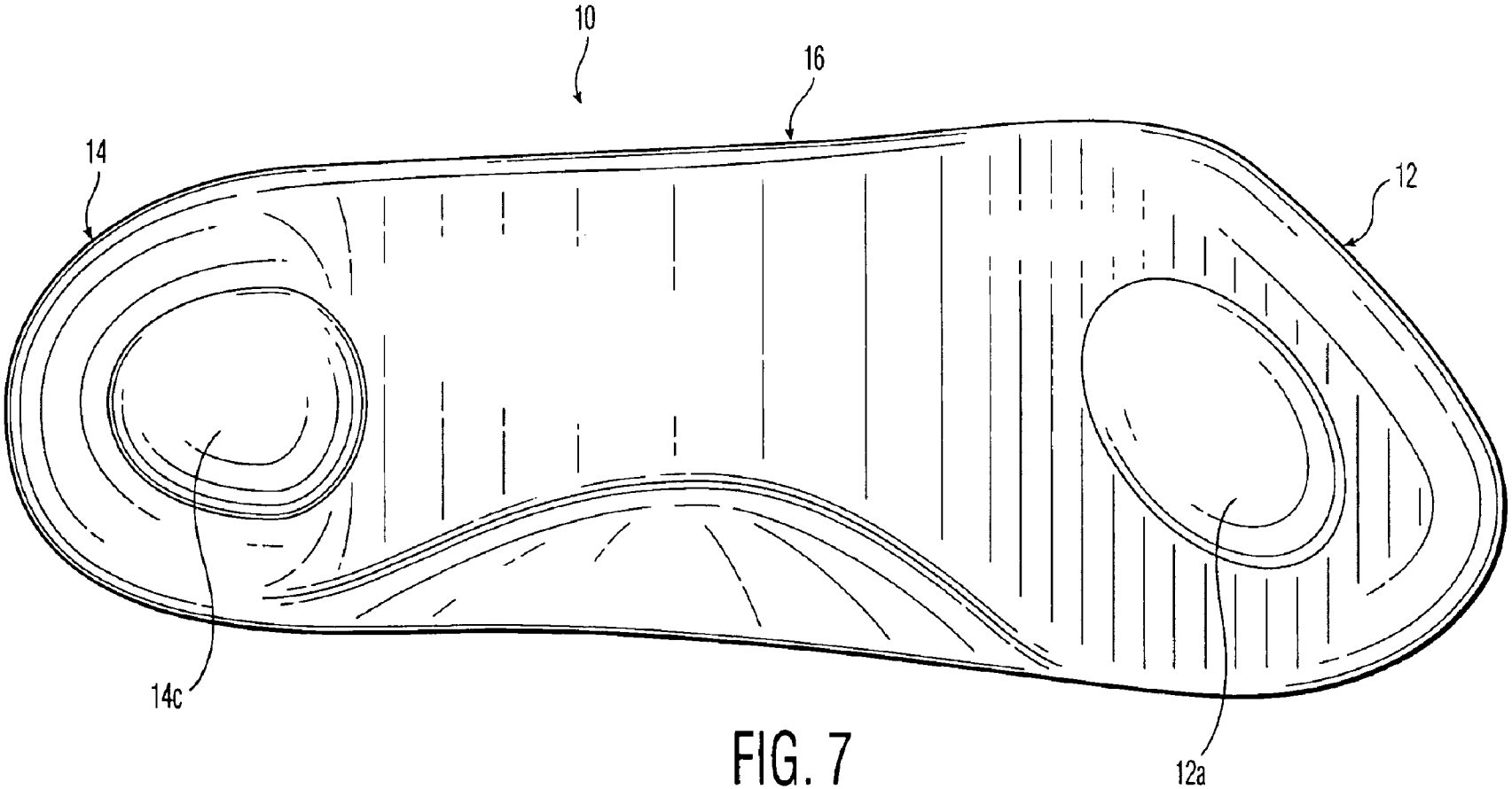
FIG. 7 is a top plan view of the insole.
Figure 8:
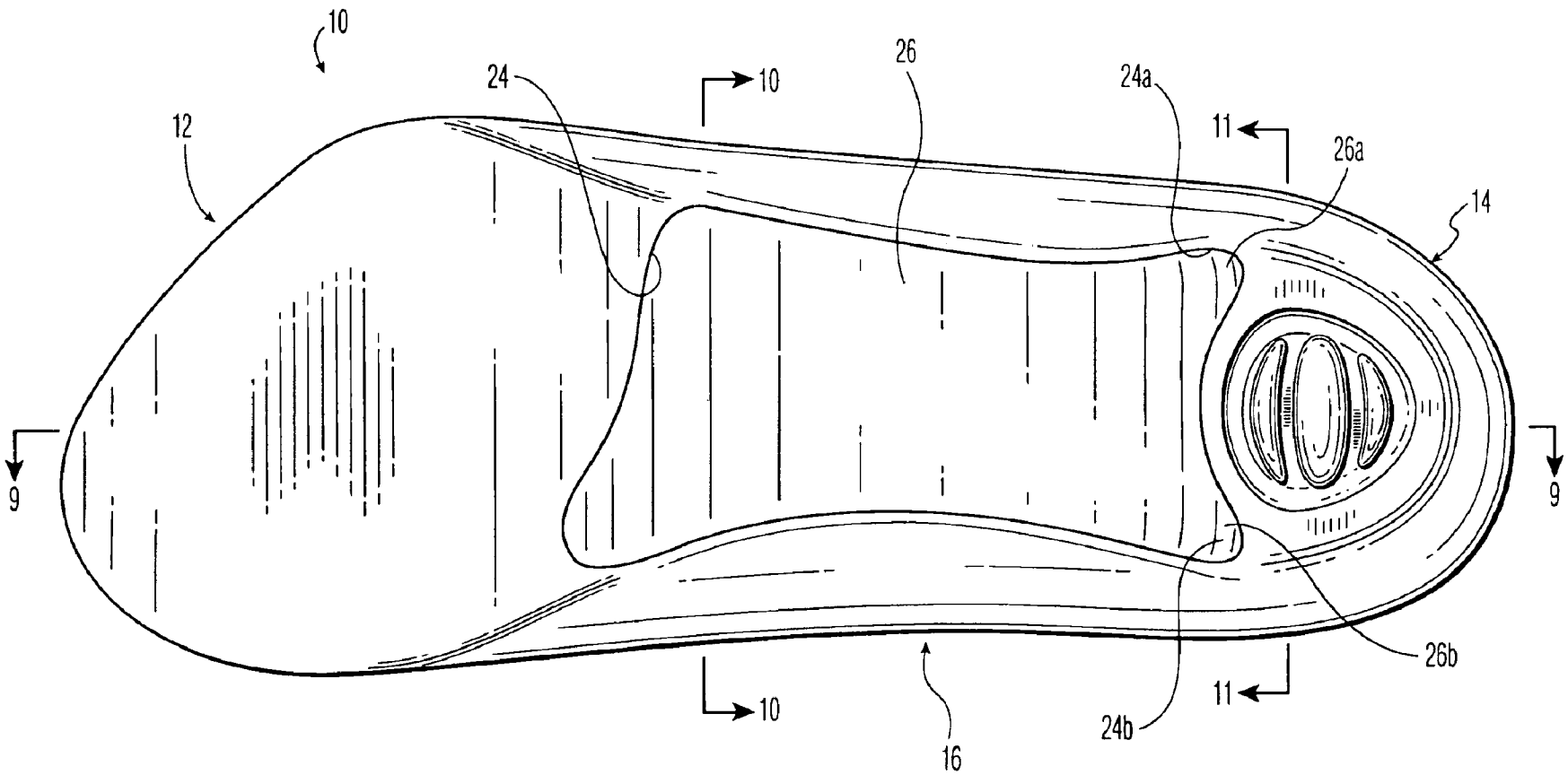
FIG. 8 is a bottom plan view of the insole.
Figure 9:
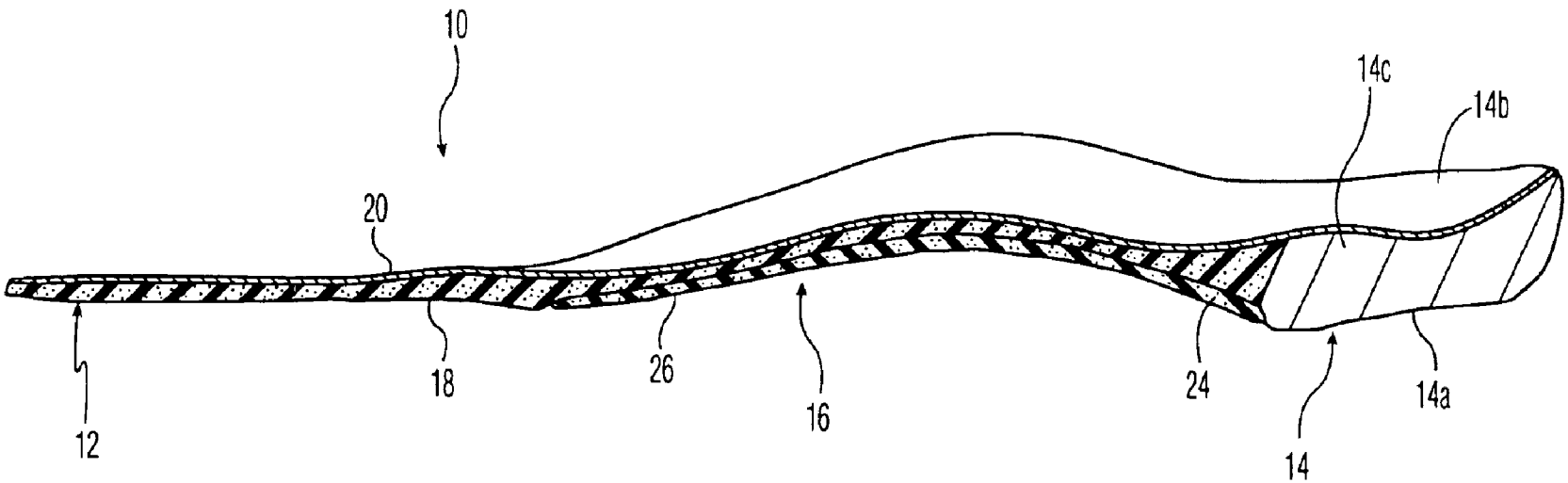
FIG. 9 is a cross-sectional view of the insole, taken along line 9—9 of FIG. 8.
Figure 10:
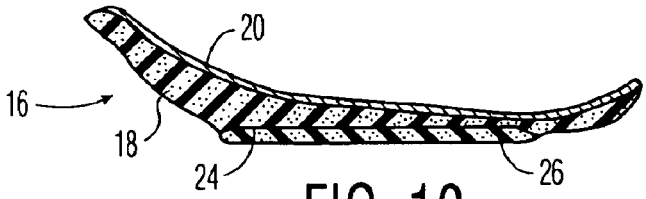
FIG. 10 is a cross-sectional view of the insole, taken along line 10—10 of FIG. 8.
Figure 11:
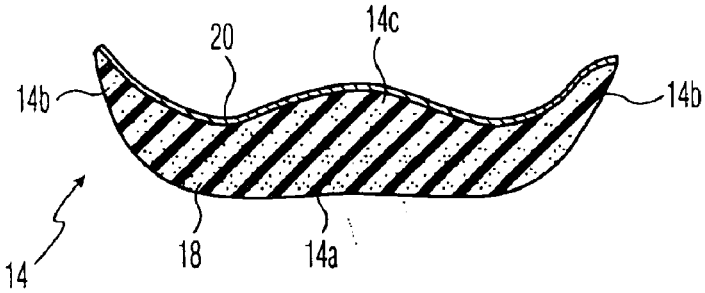
FIG. 11 is a cross-sectional view of the insole, taken along line 11—11 of FIG. 8.

Referring to the drawings in detail, a three-quarter length left insole 10 according to the present invention is adapted to be placed in an article of footwear, as is well known. Only the left insole 10 will now be described, with the understanding that the right insole (not shown) will be the mirror image of left insole 10. A "three-quarter length insole" refers to an insole with a forefoot portion that, in use, ends immediately distally of a user's metatarsals, that is, positioned just under the sulcus. In such case, an appropriately sized insole 10 can be inserted into a large variety of shoe sizes.

Specifically, insole 10 has the general shape of a human left foot and therefore includes a forefoot portion 12, a heel portion 14, and a mid portion 16 which connects forefoot portion 12 and heel portion 14 together. Heel portion 14 has a greater thickness than forefoot portion 12. For example, without limitation thereto, heel portion 14 can have a thickness of about 5–8 mm, while forefoot portion can have a thickness of about 1–3 mm. Mid portion 16 has a thickness which is frequently in the same range as forefoot portion 12 through the length thereof, but which increases in a tapering manner near the rear end thereof to meet with the increased thickness of heel portion 14. In some instances, it may be desirable to use a different thickness for the forefoot portion, such as by making the forefoot portion thinner than the midfoot portion. Thus, forefoot portion 12 and mid portion 16 together typically, but not necessarily, have a generally small constant thickness throughout, except as indicated below.

Because of the relatively small thickness of mid portion 16, in comparison with much thicker conventional mid portions having a bulky arch area, mid portion 16 is curved upwardly to correspond to an arch of a person's foot.

It will be appreciated that heel portion 14 is preferably a cupped heel portion. Specifically, as shown, heel portion 14 includes a relatively flat central portion 14*a* except as discussed below, and a sloped side wall 14*b* that extends around the sides and rear of central portion 14*a*. Generally, when a heel strikes a surface, the fat pad portion of the heel spreads out. A cupped heel portion thereby stabilizes the heel of the person and maintains the heel in heel portion 14, to prevent such spreading out of the fat pad portion of the heel and to also prevent any side-to-side movement of the heel in heel portion 14.

A pillow 14*c* is provided as a raised portion at the center of heel portion 14, and is provided at the area of heel portion 14 that receives the greatest force. Since the cushioning energy is directly proportional to thickness, the cushioning effect is normally achieved with increasing bulk of the entire insole. The present invention accomplishes this by increasing the bulk slightly by up to approximately 3 mm in thickness above the upper surface of the insole at heel portion 14, only at the area where the greatest forces result during walking. A similar pillow 12*a* is provided at forefoot portion 12 located just proximal to the user's second and third metatarsals, which is the location of the greatest forces in the forefoot during the "toe off" phase of a step.

Insole 10 is formed by a lower layer 18 and a top cover 20 secured to the upper surface of lower layer 18, along forefoot portion 12, cupped heel portion 14 and mid portion 16, by any suitable means, such as adhesive, radio frequency welding, etc.

Lower layer 18 can be made from any suitable material including, but not limited to, any flexible material which can cushion and absorb the shock from heel strike on the insole. Suitable shock absorbing materials can include any suitable foam, such as but not limited to cross-linked polyethylene, poly(ethylene-vinyl acetate), polyvinyl chloride, synthetic and natural latex rubbers, neoprene, block polymer elastomers of the acrylonitrile-butadiene-styrene or styrene-butadiene-styrene type, thermoplastic elastomers, ethylenepropylene rubbers, silicone elastomers, polystyrene, polyurea or polyurethane; preferably a flexible polyurethane foam made from a polyol chain and an isocyanate such as a monomeric or prepolymerized diisocyanate based on 4,4'-diphenylmethane diisocyanate (MDI) or toluene diisocyanate (TDI). Such foams can be blown with fluorocarbons, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees C. to 100 degrees C. may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J. U.S.A.; Pluracol 945 (CAS 9082-00-2) and Pluracol 1003, both available from BASF, Parsippany, N.J. U.S.A.; Multrinol 9200, available from Mobay, Pittsburgh, Pa. U.S.A.; MDI diisocyanate prepolymer XAS 10971.02 and polyol blend XUS 18021.00 available from Dow Chemical Company, Midland, Mich. U.S.A.; and Niax 34-28, available from Union Carbide, Danbury, Conn. U.S.A. These urethane systems generally contain a surfactant, a blowing agent, and an ultraviolet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa. U.S.A.; Fomrez UL-38, a stannous octoate, from the Witco Chemical Co., New York, N.Y. U.S.A. or A-1 (CAS 3033-62-3) available from OSI Corp., Norcross, Ga. U.S.A. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C. U.S.A., or Givsorb UV-1 (CAS 057834-33-0) and Givsorb UV-2 (CAS 065816-20-8) from Givaudan Corporation, Clifton, N.J. U.S.A. Suitable surfactants include DC-5169 (a mixture), DC190 (CAS68037-64-9), DC197 (CAS69430-39-3), DC-5125 (CAS 68037-62-7) all available from Air Products Corp., Allentown Pa. U.S.A. and L-5302 (CAS trade secret) from Union Carbide, Danbury Conn. U.S.A.

Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers).

Preferably, lower layer 18 is made from a urethane molded material such as a soft, resilient foam material having a Shore Type OO Durometer hardness in the range of 40 to 70, as measured using the test equipment sold for this purpose by Instron Corporation of Canton Mass. U.S.A. Such materials provide adequate shock absorption for the heel and cushioning for the midfoot and forefoot.

Top cover 20 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene rubber, acrylonitrile-butadiene, acrylonitrile terpolymers and copolymers, vinyls, or other acrylics, as integral top covers. Desirable characteristics of top cover 20 include good durability, stability and visual appearance. It is also desirable that top cover 20 has good flexibility, as indicated by a low modulus, in order to be easily moldable. The bonding surface of top cover 20 should provide an appropriate texture in order to achieve a suitable mechanical bond to the upper surface of lower layer 18. Top cover 20 can be a fabric, such as a brushed knit laminated top cloth (for example, brushed knit fabric/urethane film/non-woven scrim cloth laminate) or a urethane knit laminate top cloth. Preferably, top cover 20 is made from a polyester fabric material.

Lower layer 18 can be prepared by conventional methods such as heat sealing, ultrasonic sealing, radio-frequency sealing, lamination, thermoforming, reaction injection molding, and compression molding, if necessary, followed by secondary die-cutting or in-mold die cuffing. Representative methods are taught, for example, in U.S. Pat. Nos. 3,489,594; 3,530,489; 4,257,176; 4,185,402; 4,586,273, in *Handbook of Plastics*, Herber R. Simonds and Carleton Ellis, 1943, New York, N.Y.; *Reaction Injection Molding Machinery and Processes*, F. Melvin Sweeney, 1987, New York, N.Y.; and *Flexible Polyurethane Foams*, George Woods, 1982, New Jersey; Preferably, the innersole is prepared by a foam reaction molding process such as is taught in U.S. Pat. No. 4,694,589.

During use, insole 10 is placed in a shoe such that the medial side of mid portion 16 rests against the inside of the shoe. Forefoot portion 12 may end just in front of the metatarsals. However, insole 10 can also be a full-length insole, that is, extending along the entire foot.

In accordance with the present invention, insole 10 is provided with a shallow recess 24 about 2 mm deep or thick at the lower surface of lower section 18. Shallow recess 24 extends along substantially the entire mid portion 16 and tapers toward the center thereof. Thus, for example, shallow recess 24 can have a width of about 4 mm at a rear section thereof, a width of about 3.5 mm at a central section thereof and a width of about 5 mm at a front section thereof.

In addition, recess 24 has recessed corner wing sections 24*a* and 24*b* at the rear section thereof which preferably extend slightly into the heel portion 14, and the purpose for which will become apparent from the discussion which follows. It will be appreciated that, because of the curvature of mid portion 16, shallow recess 24 follows the same curvature.

A flexible and resilient arch spring insert 26 having a thickness of about 2 mm and having the same shape and dimensions as shallow recess 24, is secured within shallow recess 24. Arch spring insert 26 is made from a harder and stiffer material than the foam material of lower layer 18 of insole 10. For example, arch spring insert 26 can be made from: a fiberglass filled polypropylene; nylon; fiberglass; polypropylene; woven extrusion composite; ABS; thermoplastic polymer; carbon graphite; polyacetal, for example, that sold under the trademark "DELRIN" by E.I. du Pont de Nemours and Company of Wilmington, Del. U.S.A.; or any other suitable material.

The material used for arch spring insert 26 generally has a flexural modulus in the range of about 100,000 to 500,000 pounds per square inch ($6.89\cdot10^8$ to $3.45\cdot10^9$ Newton/meter$^2$), preferably in the range of about 150,000 to 400,000 p.s.i. ($1.03\cdot10^9$ to $2.76\cdot10^9$ N/m$^2$) and more preferably in the range of about 180,000 to 230,000 p.s.i. ($1.24\cdot10^9$ to $1.59\cdot10^9$ N/m$^2$). Techniques for measuring flexural modulus are well known to those skilled in the art.

Figure 12:
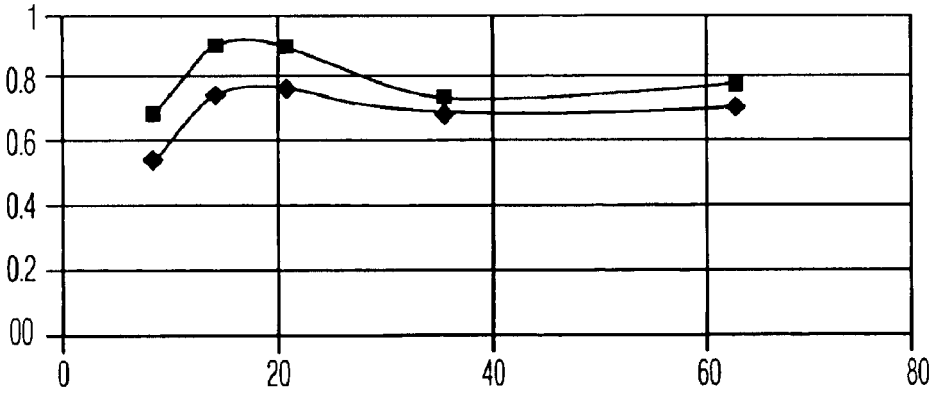
FIG. 12 is a graphical diagram of arch comfort rating versus arch stiffness with the present invention.

The arch area of insole 10 preferably has a stiffness in the range between about 5 and 60 pounds/inch (0.89 to 10.7 Kg/cm) and, more preferably, in the range between about 5 and 20 pounds/inch (0.89 to 3.57 Kg/cm). FIG. 12 shows the effect of varying the arch stiffness, where the x-axis is stiffness (expressed in pounds/inch) and the y-axis is a "comfort rating," described in more detail below. In this figure, the diamond symbol (♦) refers to satisfying 80% of the population, while the square symbol (■) refers to satisfying 90% of the population. If the stiffness falls below about 5 pounds/inch (0.89 Kg/cm), the insole 10 does not provide sufficient support. On the other hand, if the arch stiffness is significantly greater than about 60 pounds/inch (10.7 Kg/cm), the insole loses its comfort. Different prototypes that have been developed to have the above-described preferred properties have been shown to provide superior arch comfort while also providing a desired amount of support.

The method for determining stiffness involved use of an INSTRON™ compression strength testing machine, sold by Instron Corporation of Canton, Mass. U.S.A. Insoles 10 having trimmed arch flanges were placed in the platform of the test machine, equipped with a 50 pound (22.7 Kg) load cell. Measurements of the amount of deflection of the central area of the insole arch were recorded as a function of the applied load. For purposes of this invention, stiffness is defined as the ratio of an applied load to the corresponding observed amount of arch deflection, as measured over the range of applied forces.

The comfort rating was determined by surveying users of different prototype versions of insoles having varying arch stiffnesses. These subjective assessments were obtained from paired comparison crossover studies utilizing thirty men and thirty women who previously had experienced foot discomfort while wearing their shoes. The subjects had widely varying shoe sizes and represented a normal distribution of foot types. A prototype pair of insoles was worn inside the shoes by a subject for two consecutive days and at least eight hours per day, following which the subjects rated comfort, degree of support and their overall satisfaction with the insoles. Ratings were combined to achieve a comfort score for each arch stiffness tested.

Typically, arch spring insert 26 is secured in recess 24 by an adhesive, although it could also be placed in a mold and the remainder of lower section 18 of insole 10 can be molded thereon, and thereby bonded to the material of arch spring insert 26 during the molding operation.

As a person steps on insole 10, arch spring insert 26 flattens. During this operation, the flexion changes throughout the step cycle. In such case, the edges of arch spring insert 26 move outwardly so that there is no change in resistance to the weight applied to insole 10, that is, the resistance remains substantially constant, unlike the bulky foam arch portions of prior art insoles in which the resistance increases as a person steps thereon due to the compression of the material. Thus, in the operation of the present invention, arch spring insert 26 behaves much like the arch of a person's foot, which elongates as it flattens. Accordingly, arch spring insert 26 follows natural body movements and is more adaptable to different body structures and different ways of walking, that is, is more adaptable to the requirements of an individual person's foot. Therefore, insole 10 according to the present invention is suitable for different sizes, heights, weights, etc., and therefore is more versatile than conventional insoles having bulky arch portions.

The geometry and material of arch spring insert 26 can be easily engineered to optimize the range of stiffness, for example, by changing the thickness, composition, height of the arch, etc. The stiffness of the arch area of insole 10 is a function of the material used in lower layer 18 of insole 10, the nature of the material of arch spring insert 26 and the arch geometry.

Arch spring insert 26 further includes wings 26*a* and 26*b* which are secured within recessed corner wing sections 24*a* and 24*b*. Wings 26*a* permit natural motion of the foot during a stride, that is, with normal heel to arch progression. Thus, wings 26*a* allow the arch of the foot to come into play during the latter part of a heel strike, while the person's heel is still supported by the full cushion of the foam material, thereby providing a natural transition.

Thus, with the present invention, insole 10 replaces the bulky foam material in the arch portion of conventional insoles with a relatively thin flexible and resilient arch spring insert 26 that functions as a spring and which comfortably supports the arch area of the user's foot. With arch spring insert 26, insole 10 flexes and elongates as the arch of the foot flattens during a stride, thereby adapting to the requirements of each person's foot and providing a more controlled resistance. Insole 10 can be inserted in any shoes, even those with built-in arch supports, without introducing excessive bulk under the foot that can cause discomfort.

Although the present invention uses the term "insole," it will be appreciated that the use of other equivalent or similar terms such as "innersole" or "insert" are considered to be synonymous and interchangeable, and thereby included in the presently claimed invention.

Further, although the present invention has been described primarily in connection with removable insoles, the invention can be incorporated directly into the sole of a shoe, and the present invention is intended to cover the same. In this regard, reference is made in the claims to an insole for use with footware, including a removable insole or an insole built into a shoe. If built into a shoe, for example, the heel portion could be fixed and the mid portion and forefoot portions allowed to elongate as the foot flexes.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. An insole for insertion into footwear, comprising:

(a) a first layer including:

a heel portion of a first thickness, a forefoot portion, a mid portion connecting together said forefoot portion and said heel portion, said mid portion having a second thickness which is lees than the first thickness of the heel portion, and having an upward curvature, an upper surface extending along said forefoot portion, mid portion and heel portion and on which a person stands, said upper surface having said curvature at said mid portion, and a lower surface extending along said forefoot portion, mid portion and heel portion, said lower surface including a shallow recess in said mid portion, and said lower surface having said curvature at said mid portion, said first layer being made of a material having a first hardness; and (b) a flexible and resilient thin arch spring insert of a substantially constant thickness secured in said recess and following the curvature of the mid portion, said arch spring insert comprising a material having a second hardness which is greater than said first hardness;

wherein the arch spring insert has a stiffness in a range between about 5 and 60 pounds/inch that permits flexion and elongation of the mid portion am an arch of a foot flattens during a stride.

2. The insole according to claim 1, wherein said arch spring insert and said recess have substantially the same shapes and dimensions.

3. The insole according to claim 1, wherein said arch spring insert includes corner wing sect ions at a rear section thereof which extend slightly into the heel portion.

4. The insole according to claim 1, wherein said heel portion is cupped to maintain a user's heel in said heel portion.

5. The insole according to claim 1, wherein said arch spring insert tapers in width toward a central section thereof.

6. The insole according to claim 1, wherein an arch area baa a stiffness in a range between 5 and 20 pounds/inch.

7. The insole according to claim 1, wherein said forefoot portion has a length such that, when in use, the forefoot portion ends immediately distally of a user's metatarsals.

8. The insole according to claim 1, wherein said first layer comprises a soft, resilient foam material having a Shore Type 00 Durometer hardness between about 40 and about 70.

9. The insole according to claim 1, wherein said arch spring insert comprises a material having a flexural modulus between about 100,000 and about 500,000 p.s.i.

10. The insole according to claim 1, wherein said arch spring insert comprises a material having a flexural modulus between about 150,000 and about 400,000 p.s.i.

11. The insole according to claim 1, wherein said arch spring insert comprises a material having a flexural modulus between about 180,000 and about 230,000 p.s.i.

12. An insole for insertion into footwear, comprising:

(a) a first layer including:

a heel portion of a first thickness, a forefoot portion, a mid portion connecting together said forefoot portion and said heel portion, said mid portion having a second thickness which is less than the first thickness of the heel portion, and having an upward curvature, an upper surface extending along said forefoot portion, mid portion and heel portion and on which a person stands, said upper surface having said curvature at said mid portion, and a lower surface extending along said forefoot portion, mid portion and heel portion, said lower surface including a shallow recess in said mid portion, and said lower surface having said curvature at maid mid portion, said first layer comprising a material having a Shore Type 00 Durometer hardness between about 40 and about 70; and (b) a flexible and resilient thin arch spring insert of a substantially constant thickness, which approximates a depth of said shallow recess, secured in said recess and following the curvature of the mid portion, said arch spring insert comprising a material having a flexural modulus between about 100,000 and about 500,000 p.s.i.;

wherein the arch spring insert has a stiffness in a range between about 5 and 60 pounds/inch that permits flexion and elongation of the mid portion as an arch of a foot flattens during a stride.

13. The insole according to claim 12, wherein said arch spring insert and said recess have substantially the same shapes and dimensions.

14. The insole according to claim 12, wherein said arch spring insert comprises a material having a flexural modulus between about 150,000 and about 400,000 p.s.i.

15. The insole according to claim 12, wherein said arch spring insert comprises a material having a flexural modulus between about 180,000 and about 230,000 p.s.i.

16. The insole according to claim 12, wherein an arch area has a stiffness in a range between about 5 and 20 pounds/inch.

17. An insole for insertion into footwear, comprising:

(a) a first layer including:

a heel portion of a first thickness, a forefoot portion, a mid portion connecting together said forefoot portion and said heel portion, said mid portion having a second thickness which is less than the first thickness of the heel portion, and having an upward curvature, an upper surface extending along said forefoot portion, mid portion and heel portion and on which a person stands, said upper surface having said curvature at said mid portion, and a lower surface extending along said forefoot portion, mid portion and heel portion, said lower surface including a shallow recess in said mid portion, and said lower surface having said curvature at said mid portion, said first layer comprising a material having a Shore Type 00 Durometer hardness between about 40 and about 70; and (b) a flexible and resilient thin polymeric arch spring insert of a substantially constant thickness, having a substantially similar shape and dimensions of said shallow recess, secured in said recess and following the curvature of the mid portion, said arch spring insert comprising a material having a flexural modulus between about 100,000 and about 500,000 p.s.i. and having a stiffness in a range between about 5 and 60 pounds/inch that permits flexion and elongation of the mid portion as an arch of a foot flattens during a stride.

18. The insole according to claim 17, wherein an arch area stiffness is in a range between about 5 and 20 pounds/inch.

* * * * *

UNITED STATES PATENT AND TRADEMARK OFFICE

CERTIFICATE OF CORRECTION

PATENT NO. : 6,915,598 B2
APPLICATION NO. : 10/212913
DATED : July 12, 2005
INVENTOR(S) : Grisoni, Bernard F.

It is certified that error appears in the above-identified patent and that said Letters Patent is hereby corrected as shown below:

Col. 7, claim 1(a), line 55, please correct “lees” to -- less --.

Col. 8, claim 1(b), line 9, please correct “am” to -- as --.

Col. 8, claim 3, line 14, please correct “sect ions” to -- sections --.

Col. 8, claim 6, line 22, please correct “baa” to -- has --.

Signed and Sealed this

Twelfth Day of September, 2006

JON W. DUDAS
*Director of the United States Patent and Trademark Office*